US010364605B2

(12) United States Patent
Slaughter, Jr.

(10) Patent No.: US 10,364,605 B2
(45) Date of Patent: Jul. 30, 2019

(54) ROTARY PERCUSSIVE DEVICE

(71) Applicant: Smith International, Inc., Houston, TX (US)

(72) Inventor: Robert H. Slaughter, Jr., Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 97 days.

(21) Appl. No.: 15/307,481

(22) PCT Filed: Apr. 14, 2015

(86) PCT No.: PCT/US2015/025738
§ 371 (c)(1),
(2) Date: Oct. 28, 2016

(87) PCT Pub. No.: WO2015/167796
PCT Pub. Date: Nov. 5, 2015

(65) Prior Publication Data

US 2017/0051560 A1 Feb. 23, 2017

Related U.S. Application Data

(60) Provisional application No. 61/985,261, filed on Apr. 28, 2014.

(51) Int. Cl.
*E21B 6/02* (2006.01)
*E21B 4/02* (2006.01)
(Continued)

(52) U.S. Cl.
CPC ..... *E21B 6/02* (2013.01); *E21B 4/02* (2013.01); *E21B 4/14* (2013.01); *E21B 1/00* (2013.01);
(Continued)

(58) Field of Classification Search
CPC ..... E21B 6/02; E21B 6/04; E21B 4/14; E21B 4/12; E21B 4/10; E21B 4/02
See application file for complete search history.

(56) References Cited

U.S. PATENT DOCUMENTS 4,890,682 A 1/1990 Worrall et al.
2008/0252150 A1 10/2008 Grundl et al.
(Continued)

OTHER PUBLICATIONS

International Search Report and Written Opinion for International Application No. PCT/US2015/025738, dated Jul. 30, 2015, 10 pgs.

*Primary Examiner* — Kristyn A Hall

(57) ABSTRACT

Repeated percussive forces may be provided using various devices, systems, assemblies, and methods. Example rotary percussive devices may be used in a downhole environment, including within a drilling system that includes a percussive hammer drill bit. The rotary percussive device may include a rotational translator to convert drilling fluid pressure into a rotational force. An axial translator coupled to the rotational translator may convert the rotational force into an axial percussive force. This conversion may be done using magnets arranged in arrays of alternating polarities. The rotational translator may longitudinally overlap the axial translator. The rotational translator may include a rotational stator rotationally fixed within a bottomhole assembly. The rotational stator may include a shaft of a positive displacement motor.

17 Claims, 10 Drawing Sheets

(51) Int. Cl.

| | |
|---|---|
| ***E21B 4/14*** | (2006.01) |
| *E21B 4/06* | (2006.01) |
| *E21B 7/12* | (2006.01) |
| *E21B 7/14* | (2006.01) |
| *E21B 1/00* | (2006.01) |
| *F01D 15/00* | (2006.01) |

(52) U.S. Cl.
CPC . *E21B 4/06* (2013.01); *E21B 7/12* (2013.01); *E21B 7/14* (2013.01); *F01D 15/00* (2013.01)

(56) References Cited

U.S. PATENT DOCUMENTS

| | | | | |
|---|---|---|---|---|
| 2010/0187009 | A1 | 7/2010 | Siher et al. | |
| 2012/0018218 | A1 | 1/2012 | Rosenhauch | |
| 2013/0277116 | A1 | 10/2013 | Knull et al. | |
| 2014/0054090 | A1* | 2/2014 | Schicker | E21B 4/10 175/95 |
| 2015/0144329 | A1* | 5/2015 | Schultz | E21B 17/1021 166/241.1 |

* cited by examiner

ROTARY PERCUSSIVE DEVICE

CROSS-REFERENCE TO RELATED APPLICATIONS

This application claims the benefit of and priority to U.S. Provisional Application No. 61/985,261, filed on Apr. 28, 2014, the entirety of which is incorporated herein by reference.

BACKGROUND

Wells can be drilled into a surface location or subsea, ocean bed to access liquid and gaseous hydrocarbons, or other fluids, stored in subterranean formations. A well may be drilled using a drill bit attached to the end of a drill string. Example drill strings may include segments of drill pipe, drill collars, a bottomhole assembly ("BHA"), and additional components that facilitate rotation of the drill bit to remove formation materials and create a wellbore. During the drilling process, drilling fluid, commonly referred to as "drilling mud" or "mud," can be pumped through the drill string to nozzles within the drill bit. The drilling fluid provides lubrication and cooling to the drill bit during the drilling operation, and carries drill cuttings to the surface through an annular channel between the drill string and wellbore wall.

The drilling fluid pressure may be leveraged to operate components in the BHA. For example, the BHA may include a mud motor located above the drill bit. The drilling mud provides a fluid pressure that the mud motor converts to a force usable by the drill bit or other parts of the BHA to penetrate a formation. The mud motor may be a rigid portion of the BHA and primarily responsible for generating torque for rotating the drill bit to break apart rock within the formation. The drill bit that is used may include a roller cone bit, a fixed cutter bit, or the like. An example drill bit may include a fixed cutter drill bit with polycrystalline diamond compact ("PDC") cutters. When the drill bit is rotated, the PDC cutters can mechanically shear or break material from the surrounding formation. For a drill bit coupled to a mud motor to apply high forces, such as where very hard rocks and minerals are contained within the surrounding formation, the mud motor may be used to generate high levels of torque.

In some formations, repeated percussive forces may be effective in penetrating the surrounding rock and/or other material. The repeated percussive forces may be applied through a percussion hammer drill bit that uses linear, axial movement of the drill bit to break or otherwise remove material from a surrounding formation. The energy for the material removal is therefore produced by the impact of the total weight of the drill string and linear inertia of the percussive device, and the percussive device may not need the high levels of torque used by a rotary PDC drill bit.

Traditional methods of providing a repeated percussive force in a bottomhole assembly include an air hammer for air drilling applications, or a fluid hammer for more conventional drilling in which fluid may be used to lubricate the drill bit and provide circulation of drilling fluid through the wellbore and drill string. The use of an air hammer is largely used in applications in which drilling fluid is not used, and is therefore commonly used in more shallow wells that do not have formation fluid entering the wellbore. A fluid hammer or "mud hammer" provides a repeated percussive force using a fluid, such as the drilling fluid, to generate a hydraulic pressure to provide energy in an axial direction.

SUMMARY

In an embodiment, a rotary percussive device may include a rotational translator with a rotational rotor and a rotational stator. An axial translator may be concentric with the rotational translator, and may include an axial stator.

In accordance with another embodiment of the present disclosure, a bottomhole assembly may include a percussive device and a downhole tool. The percussive device may include a rotational translator that converts fluid pressure to torque using a rotational rotor and a rotational stator. An axial translator of the percussive device may be concentric with the rotational translator, and may include an axial stator and an axial rotor that cooperate to convert rotational movement of the axial rotor into axial movement of the axial stator. Rotation of the axial rotor may be produced by the rotational translator which may be coupled to the axial rotor. The axial stator may cause a percussion hammer drill bit to also move axially. The downhole tool of the bottomhole assembly may be coupled to the percussive device and may provide a fluid passageway to the rotational translator. The rotational stator may also be rotationally fixed to the downhole tool.

A method of providing rotary power to a rotary percussive device is also disclosed in accordance with some embodiments. Torque may be produced using a rotational translator including a rotational stator and rotational rotor. The torque may be used to cause the rotational rotor to rotate. That rotation may then be converted to axial motion by causing an axial stator to move axially. The axial stator may be positioned so as to longitudinally overlap the rotational stator.

This summary is provided to introduce a selection of concepts that are further described below in the detailed description. This summary is not intended to be used as an aid in limiting the scope of the disclosure or the claimed subject matter. Additional features and aspects of the disclosure will be set forth in the description which follows, and in part will be apparent to a person having ordinary skill in the art with the benefit of the description, or may be learned by the practice of the example embodiments described.

BRIEF DESCRIPTION OF THE DRAWINGS

A more particular description of some embodiments of the present disclosure will be rendered by reference to specific embodiments illustrated in the appended drawings. Understanding that these drawings depict typical embodiments of the disclosure and are not therefore to be considered to be limiting of its scope, the embodiments will be described and explained with additional specificity and detail through the use of the accompanying drawings in which:

FIG. 7-1 is a cross-sectional view of an example magnetic axial translator with an axial rotor and axial stator in a first position, in accordance with an embodiment of the present disclosure;

FIG. 7-2 is a cross-sectional view of the magnetic axial translator of FIG. 7-1, with the axial rotor and axial stator in a second position, in accordance with another embodiment of the present disclosure;

DETAILED DESCRIPTION

One or more specific embodiments of the present disclosure will be described below. In an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. It should be appreciated in view of the disclosure herein that such a development effort might be complex and time consuming, but would nevertheless be a routine undertaking of design, fabrication, and manufacture for those of ordinary skill having the benefit of this disclosure. The specific embodiments shown and described are therefore illustrative examples of some embodiments which are within the scope of the present disclosure.

Embodiments of the present disclosure generally relate to drilling tools. Example drilling tools may include drill bits, including percussion hammer drill bits. In some embodiments, drilling tools disclosed herein may have low operational wear on components and high maneuverability in downhole applications. According to at least some embodiments, the drilling tool receive a rotational force from the surface, or may convert an energy source provided from a drilling platform or rig at the surface to a rotational force. The energy source may be a flow of air or a drilling fluid. The drilling tool may then convert that rotational force into an axial force, which may then be delivered to a surrounding formation by a drill bit. The axial force may be a periodic and/or oscillating force. The drill bit may accordingly transmit a repeated percussive impact to the surrounding formation in order to break or otherwise remove material from the formation in a wellbore. The flow of drilling fluid may then mobilize the broken or removed material and move it away from the impact site.

Figure 1:
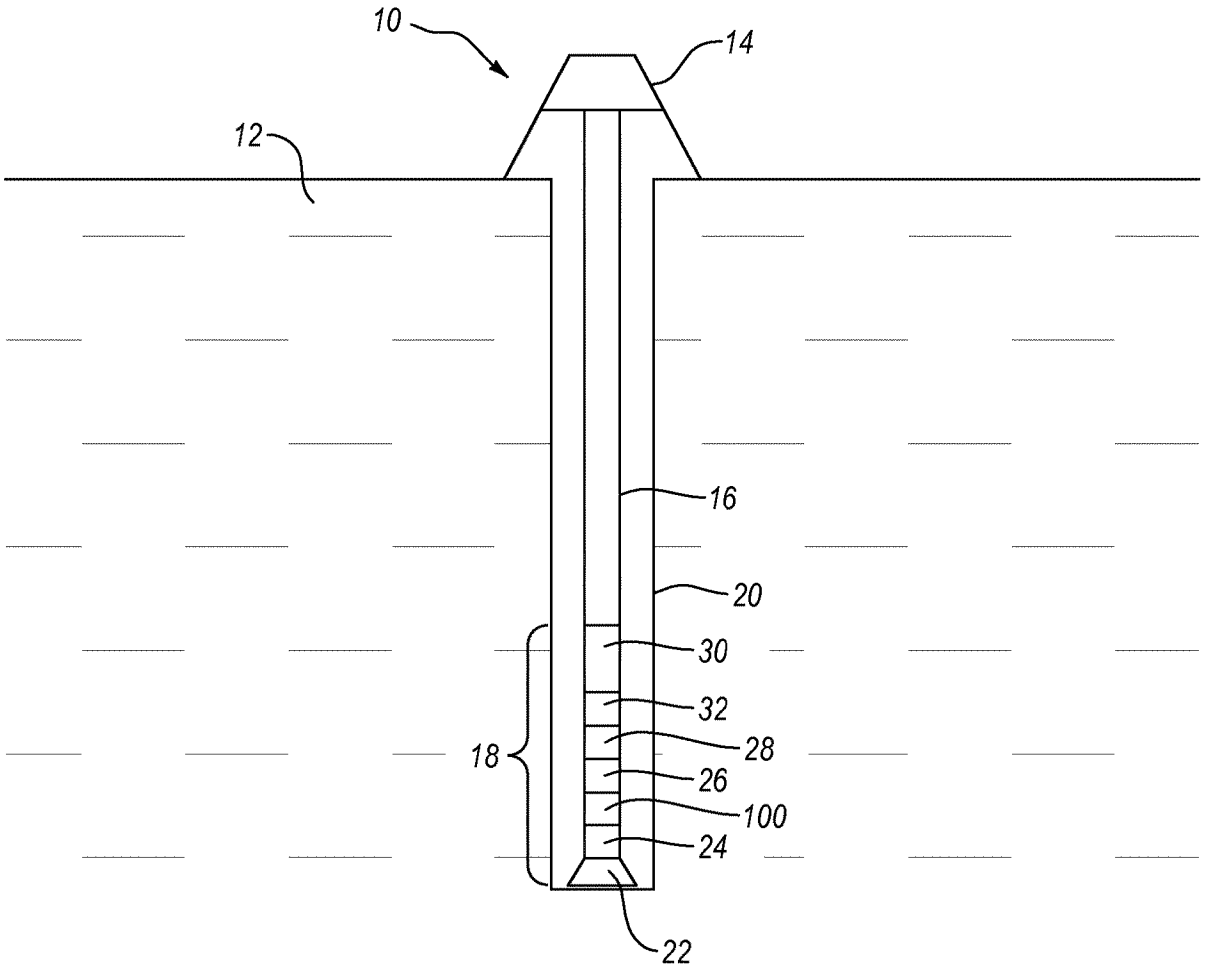
FIG. 1 is a schematic diagram of a drilling system including a percussive device, in accordance with an embodiment of the present disclosure.

By way of introduction, FIG. 1 illustrates a drilling system 10 for drilling through a subsurface formation 12. The drilling system 10 may be used to drill and form a wellbore 20. To that end, the illustrated drilling system 10 may include a platform 14 and one or more tubular elements or bodies. Example tubular elements may include a drill string 16 and a bottomhole assembly ("BHA") 18 at a terminal end of the drill string 16. The drilling system 10 is illustrative only, and in other embodiments additional or other components may be provided. For instance, the drilling system 10 may include a floating platform for a subsea well, drill collars, conveyance equipment, vibrational devices, measurement or logging tools, communication devices (e.g., mud-pulse telemetry transmitters), other tools or devices, or any combination of the foregoing.

The BHA 18 may include or provide an assembly of components useful for drilling the wellbore 20. For instance, the BHA 18 may include a bit 22, a bit sub 24, a drill collar 26, stabilizers 28, drill pipe 30, jars 32, other components, or any combination of the foregoing. In addition, the BHA 18 may include a percussive device 100 for providing force for the bit 22 to penetrate the surrounding formation 12. The surrounding formation 12 may have a variety of types of rock and/or fluid, and the amount and type of force for penetrating different formations may vary accordingly. In some applications, the percussive device 100 may provide a repeated percussive force (as opposed to a constant or other shearing force) to penetrate the subsurface formation 12 and extend or form the wellbore 20. In such an embodiment, the bit 22 may be a percussion hammer drill bit.

Figure 2:
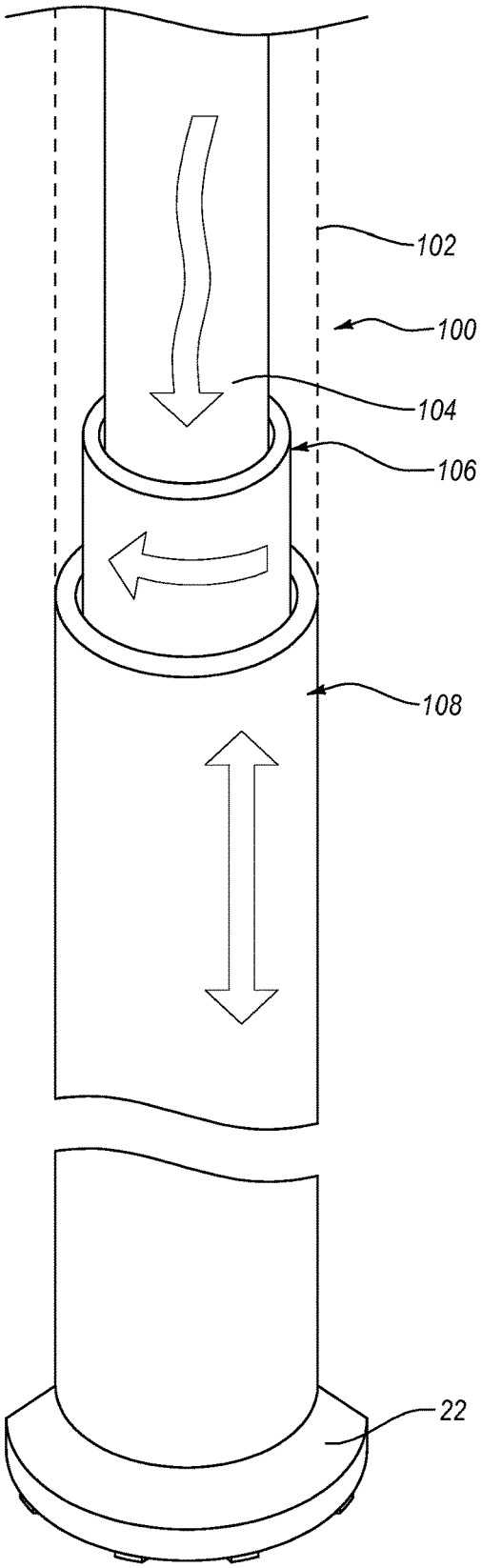
FIG. 2 is a schematic diagram of a percussive device, in accordance with an embodiment of the present disclosure.

FIG. 2 is a schematic representation of a percussive device 100 that may be used in a downhole environment and connected to a bit 22. The percussive device 100 may be connected to other downhole tools 102 (dashed out) located, in this embodiment, above the percussive device 100. Examples of the other downhole tools 102 may include components of the drill string 16 and/or the BHA 18 of FIG. 1 (e.g., drill collars, stabilizers, drill pipe, jars, etc.) Additionally, the other downhole tools 102 to which the percussive device 100 may be connected may include other components such as reamers, mills, vibration dampeners, measurement tools, logging tools, data transmitters, sensors, other tools, or any combination of the foregoing. In an embodiment in which the other downhole tools 102 include a dampener, such device may be used to at least partially dampen the vibrations or forces generated by the percussive device 100, and potentially by other components below the percussive device 100, to protect other components of the drilling system above the percussive device 100. In other embodiments, the percussive device 100 may be connected to the drill string 16, and potentially above the other downhole tools 102.

The percussive device 100 may receive energy from an energy source. In some embodiments, the energy source may be located at or near the surface, and the energy may be provided to operate the percussive device 100. As depicted in FIG. 2, the energy may be provided to the percussive device 100 by a flow of drilling fluid 104. The drilling fluid 104 may include water-based mud, oil-based mud, or other fluid circulated within the drill string 16 during a drilling operation. The drilling fluid 104 may be pumped downwardly into the percussive device 100 by a fluid pump at or near the surface of the corresponding wellbore (e.g., on the drilling platform 14 of FIG. 1) and may be delivered to the percussive device 100 through the drill string 16 and through a fluid passageway provided by the other downhole tools 102, if any. The fluid pump may be used to change the drilling fluid pressure and/or flow rate to control the amount of input energy to the percussive device 100 and to control the force or rate of penetration achieved during drilling. In other embodiments, the energy for the percussive device 100 may be electrical energy provided by a generator inside or outside the wellbore, may be rotational energy provided by a top drive or kelly table, or may be provided in other manners.

The percussive device 100 may include a rotational translator 106 and an axial translator 108, both of which are represented schematically in FIG. 2. The rotational translator 106 may convert the energy provided to operate the percussive device 100 into rotational energy. The rotational energy may cause a substantially continual rotational motion of at least part of the rotational translator 106. The rotational translator 106 may therefore, in some embodiments, be an example of a means for converting axial motion into continuous rotational motion.

The axial translator 108 may convert the rotational motion of the rotational translator 106 into an axial motion of at least a part of the axial translator. In some embodiments the axial motion may be a periodic, oscillating axial motion. FIG. 2 depicts the axial translator 108 concentric with, and external to, the rotational translator 106. In other embodiments, the axial translator 108 may be concentric with, and internal to, the rotational translator 106. In some embodiments, the axial translator 108 is an example of a means for converting rotational motion to oscillating axial motion. The axial translators 108 and rotational translators 106 described and depicted herein also represent some examples of means for providing percussive forces to a bit (e.g., a percussion hammer drill bit) through concentrically positioned axial and rotational translators As used herein, "concentrically" or "concentric" should be understood to encompass two objects in which a first object is at least partially within a second object, irrespective of shape, such that the first object is entirely contained within the second object in a lateral or radial direction, while the two objects also at least partially longitudinally overlap one another. For example, when a first circle has another circle therein which does not extend radially outward past the first circle, the circles should be understood to be concentric circles. Likewise, when a first square has a second square wholly therein, the squares should be understood to be concentric squares. Additionally, when a circle has a square wholly therein, the shapes should be understood as being concentric shapes. A first cylinder that is at least partially inside a second cylinder so as to have full radial overlap (i.e., when viewed from an end the first cylinder is wholly within the second cylinder in a radial or lateral direction) and at least some longitudinal overlap with the second cylinder should be understood to be concentric with the second cylinder. In accordance with some embodiments described herein, concentric shapes or structures described herein may have a common center point or axis; however, other embodiments are contemplated in which the shapes or structures have a different center point or axis. Thus, concentric structures of the present disclosure may have a common axis of rotation, but may also have different axes of rotation. Where concentric structures have different axes of rotation, the axes may be radially and/or angularly offset.

Additionally, when referring to concentric structures in the present disclosure, "rotate concentrically" or "move concentrically" should be understood to encompass movement in which a first component rotates or moves and remains radially and at least partially longitudinally within a second component, or in which a first component rotates or moves and the second component remains radially and at least partially longitudinally within the first component. A first component that rotates concentrically with respect to a second component may or may not share an axis of rotation with the second component.

By way of example, when a first circle is inside and concentric with a second circle and one or each rotate such that the first circle remains within the second circle, the circles should be considered to rotate concentrically, whether or not the circles have a common axis of rotation, and whether or not the axis of rotation of one or both of the circles changes. Thus, rotation of the first circle relative to the second circle should be understood to be concentric, and rotation of the second circle relative to the first circle should be understood to be concentric. Furthermore, eccentric or other non-circular movement should also be understood as "concentric rotation" or "concentric movement" as used herein. For instance, eccentric movement of a structure within or about another structure should be understood to be concentric when the inner component remains radially and at least partially longitudinally within the outer component.

With continued reference to FIG. 2, when the rotational translator 106 is concentrically within the axial translator 108, or when the axial translator 108 is concentrically within the rotational translator 106, the percussive device 100 may be shorter in length than percussive devices in which a rotational translator is offset axially/longitudinally relative to an axial translator. In at least some embodiments, the rotational translator 106 may be shorter than the axial translator 108, or the axial translator 108 may be shorter than the rotational translator. Thus, in some embodiments, the entire length of the rotational translator 106 may overlap the length of the axial translator 108, or the entire length of the axial translator 108 may overlap the length of the rotational translator 106. In other embodiments, the rotational translator 106 may partially longitudinally overlap the axial translator 108 to extend longitudinally from or beyond an upward or downward end of the rotational translator. In still other embodiments, the axial translator 108 may partially longitudinally overlap the rotational translator 106 to extend longitudinally from or beyond an upward or downward end of the rotational translator 106. In an embodiment, the percussive device may be less than about 33 feet (10.1 meters) in length. In another embodiment, the percussive device 100 may be less than about 15 feet (4.5 meters) in length. In yet another embodiment, the percussive device may be less than about 10 feet (3.0 meters) in length. The concentric design of the percussive device 100 may also allow a portion of the rotational translator 106 to be within the axial translator 108, or vice versa.

The amount of the rotational translator 106 within the axial translator 108 may be varied in different embodiments. For instance, in at least some embodiments, the amount of the rotational translator 106 within the axial translator 108 may be more than 40%, more than 50%, more than 60%, more than 70%, more than 75%, more than 80%, more than 90%, or more than 95%. In other embodiments, less than 40% (e.g., between 10% and 40%, between 20% and 40%, or between 30% and 40%), or more than 95% (e.g., the entire rotational translator 106, or substantially the entire rotational translator 106), may be within the axial translator 108. In determining the amount of the rotational translator 106 within the axial translator 108, the percentages above may be based on a length of the axial translator. In the same or other embodiments, however, the width and/or mass of the axial translator may also, or instead, be used with the same percentages It should be understood in view of the present disclosure that the concentric position of the rotational translator 106 and the axial translator 108 may be reversed with at least a portion of the axial translator 108 within the rotational translator 106. For instance, in terms of length, width, mass, or some combination of the foregoing, the amount of the axial translator 108 within the rotational translator 106 may be more than 40%, more than 50%, more than 60%, more than 70%, more than 75%, more than 80%, more than 90%, or more than 95%. In other embodiments, less than 40% (e.g., between 10% and 40%, between 20% and 40%, or between 30% and 40%), or more than 95% (e.g., the entire axial translator 108, or substantially the entire axial translator 108), may be within the rotational translator 106.

Figure 3:
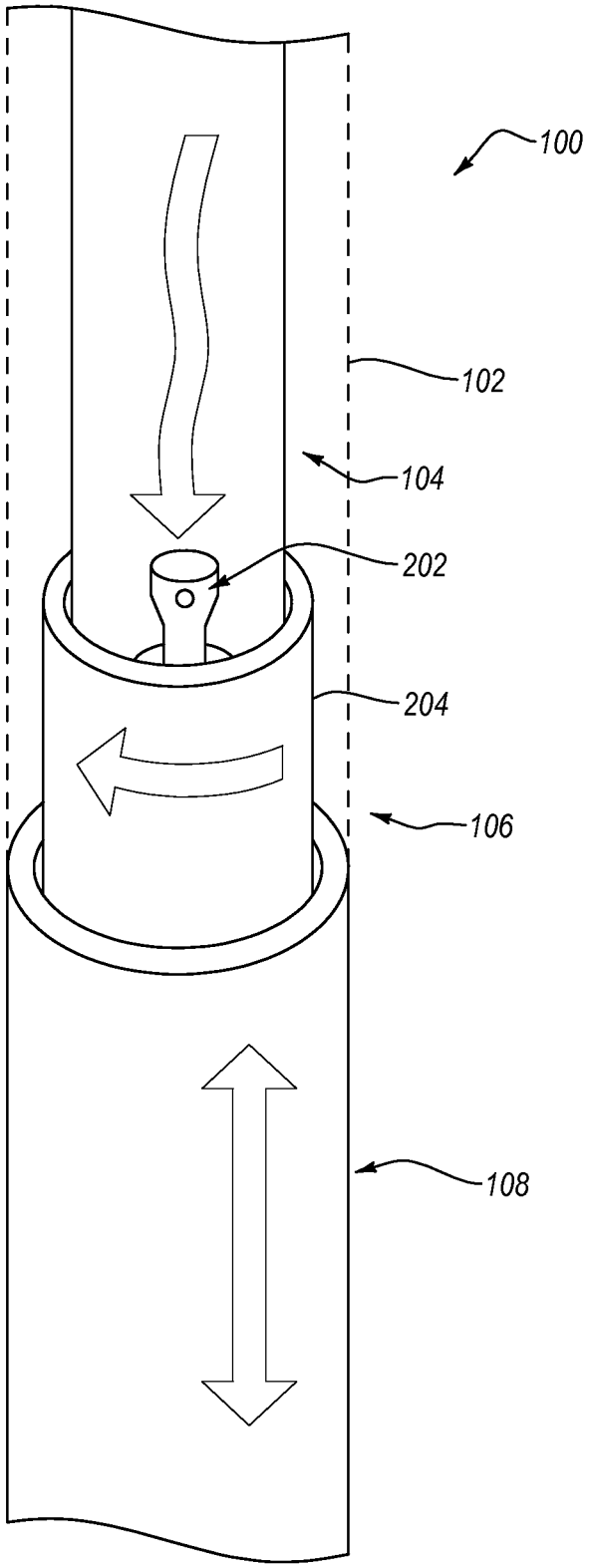
FIG. 3 is a schematic diagram of a rotational translator of a percussive device, in accordance with an embodiment of the present disclosure.

FIG. 3 is a schematic representation of another embodiment of a percussive device 100, and particularly illustrates a rotational translator 106 and an axial translator 108 in additional detail. The rotational translator 106 may convert the input energy from the flow of drilling fluid 104 into rotational energy, motion, and torque. As shown, an embodiment of the rotational translator 106 may include a rotational stator 202 and a rotational rotor 204. In some embodiments, the rotational stator 202 and the rotational rotor 204 are collectively and individually examples of means for converting axial motion into continuous rotational motion.

The rotational stator 202 may be fixed relative to one or more of the other downhole tools 102 and/or the drill string (e.g., rotationally fixed), while the rotational rotor 204 may be able rotate about a rotational axis relative to the rotational stator 202 and the other downhole tools 102. In the illustrated embodiment, the rotational stator 202 is shown as being concentrically internal to the rotational rotor 204. The In some embodiments, at least a portion of the rotational translator 106 may rotate concentrically with at least a portion of the axial translator 108. For instance, the rotational rotor 204 may rotate relative the axial translator 108 and/or some or all of the axial translator 108 may rotate relative to the rotational stator 202. In other embodiments, the rotational stator 202 may be concentrically external to the rotational rotor 204.

The rotational translator 106 of the percussive device 100 may be used to rotate the rotational rotor 204 relative to the rotational stator 202. In some embodiments, such rotation may produce the same or similar torque or power as a traditional mud motor in a BHA when used for drilling into the surrounding formation with a rotary drill bit (e.g., a fixed cutter bit, an impregnated diamond bit, a roller cone bit, or the like). In other embodiments, the rotation of the rotational rotor 204 relative to the rotational stator 202 may produce a reduced amount of maximum torque relative to a traditional mud motor. In some embodiments of the present disclosure, the rotational translator 106 may produce less than 10,000 foot-pounds (13.6 kilonewton-meters) of torque, less than 5,000 foot-pounds (6.8 kilonewton-meters) of torque, less than 1,500 foot-pounds (2.0 kilonewton-meters) of torque, less than 1,100 foot-pounds (1.5 kilonewton-meters) of torque, or less than 500 foot-pounds (680 newton-meters). In still other embodiments, the rotational translator 106 may be used to produce more than 10,000 foot-pounds (13.6 kilonewton-meters) of torque, or less than 500 foot-pounds (680 newton-meters) of torque. The torque values represented above may, in some embodiments, represent the rating of the rotational translator in terms of maximum torque, or in terms of torque produced under certain specified operating conditions (e.g., flow rate, fluid density, fluid type, etc.). In at least some embodiments, the torque values of the rotational translator 106 may be at least 10% less, at least 20% less, at least 30% less, at least 40% less, at least 50% less, at least 60% less, at least 70% less, at least 80% less, or at least 90% less than the values of a comparable mud motor for rotational drilling.

Figure 4:
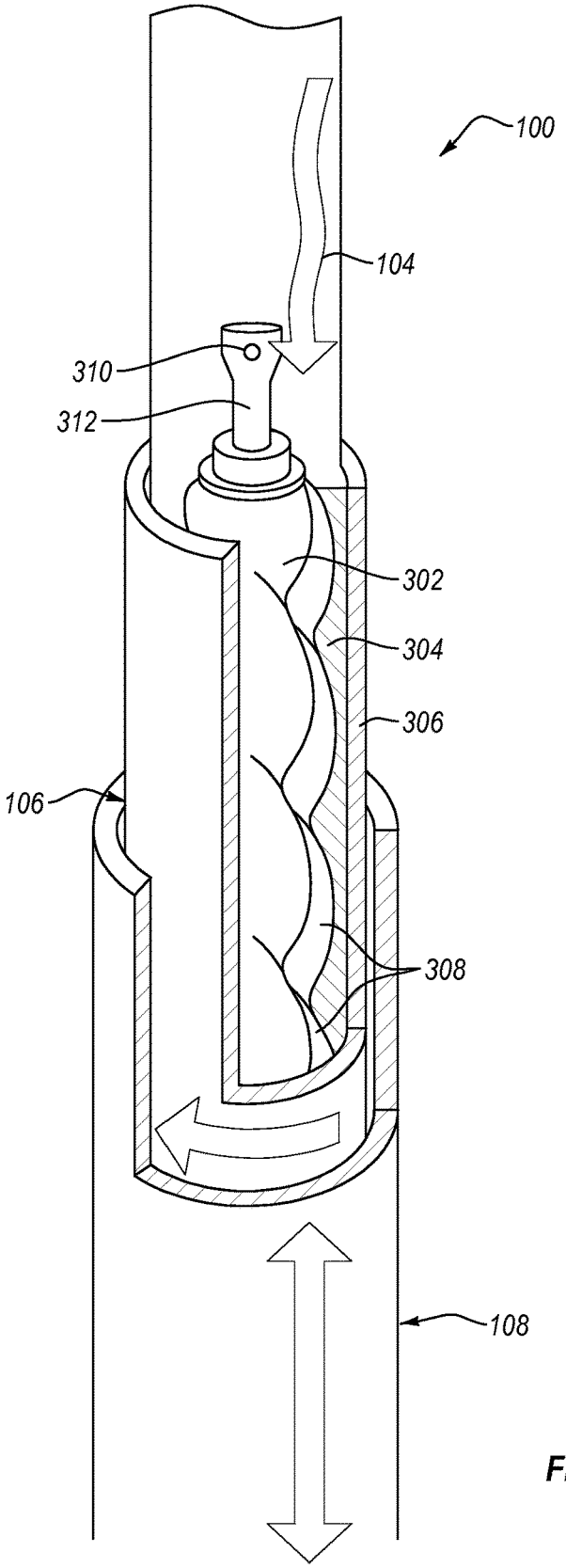
FIG. 4 depicts the rotational translator of FIG. 3 where the rotational translator is a positive displacement motor, in accordance with an embodiment of the present disclosure.

FIG. 4 depicts an embodiment of a rotational translator 106 in which the rotational translator 106 is a positive displacement motor ("PDM"). Various types of PDMs may be utilized in accordance with embodiments of the present disclosure, including progressive cavity motors, Moineau motors, rotary-type positive displacement motors, other types of motors, or some combination of the foregoing. In other embodiments, the rotational translator 106 may be or include a turbine or an electric motor. Also included in FIG. 4 is an axial translator 108 concentrically external to the rotational translator 106. Examples of possible embodiments of suitable axial translators 108 will be discussed further in relation to FIGS. 5 through 8.

The rotational translator 106 may include a rotational stator 302 concentric with a rotational rotor 304 coupled to, or integrally formed with, a rotor body 306. In some embodiments, the rotational stator 302 and the rotational rotor 304 are collectively and individually examples of means for converting axial motion into continuous rotational motion. The rotor body 306 may be rotationally fixed relative to the rotational rotor 304. In some embodiments, the rotational rotor 304 may be formed of, or include, a molded elastomer. In other embodiments, the rotational rotor 304 may include additional or other materials.

The rotational stator 302 and rotational rotor 304 may form a series of cavities 308. As the fluid 104 moves axially/longitudinally through the rotational translator 106, the cavities 308 may help create a pressure differential that rotates the rotational rotor 304, and hence the rotor body 306. The rotational stator 302 may be coupled to a BHA, drill string, or other downhole tools (e.g., other downhole tools 102 of FIG. 3) by a connection point 310 and/or through a connection rod 312. Optionally, the connection rod 312 may include one or more joints or linkages. The one or more joints or linkages may allow the connection rod 312 to compensate for eccentric movement of the rotational stator 302 relative to the connection point 310 when the rotational translator 106 is a PDM or other similar device. In other embodiments, the rotational stator 302 may be coupled to the BHA or other downhole tools in other or additional manners (e.g., one or more welds, bolts, clamps, etc.). When the rotational translator 106 is a PDM, the connection rod 312 may, in some embodiments, include or be coupled to a drive shaft of the PDM (e.g., an eccentrically mounted drive shaft, a hypocycloid-shaped drive shaft, etc.).

The rotational stator 302 may be rotationally fixed relative to the BHA and/or other downhole tools. In such an embodiment, as the fluid 104 passes into the rotational translator 106, the rotational stator 302 may remain rotationally fixed relative to the drill string, BHA, or other downhole tools, and the rotational rotor 304 may rotate. In other embodiments, however, the rotational stator 302 may not be rotationally fixed relative to the BHA or other downhole tools. In an embodiment, the rotational stator 302 may be capable of rotation relative to the BHA, drill string, or other downhole tools. For example, the rotational stator 302 may be connected to a connection point 310 that may rotate, or be coupled to the BHA, drill string, or other component using one or more bearings. Rotation of the rotational stator 302 relative to the BHA may allow for altered rates of rotation relative to the rotational rotor 304. Changing the rotation rate of the rotational stator 302 and rotational rotor 304 may allow for changes in the amplitude or period of the percussive force generated by the percussive device 100. In another embodiment, the connection rod 312 may include a gearing system or other ratio components. In such embodiment, the connection point 310 may be rotationally fixed, but the rotational stator 302 may be capable of rotating relative to the connection point 310, albeit at a different rate than the rotational rotor 304. The rotational stator 302 and rotational rotor 304 may therefore rotate relative to one another (e.g., rotate concentrically), but the relative rotations of the rotational stator 302 and rotational rotor 304 may be altered independent of the input energy, for example, by altering the gearing or other ratio components.

Altering the relative rotational rate of the rotational stator 302 and rotational rotor 304 may allow for a lower or higher rotation rate of the rotational rotor 304 without altering the input energy from the energy source. In an embodiment, the relative rotation rate may be altered such that the rotation of the rotational rotor 304 may be slower at a constant flow rate for drilling fluid. In another embodiment, the relative rotation rate may be altered such that the rotation of the rotational rotor 304 may be faster at a constant flow rate for drilling fluid. This variation capability may allow for a lower required drilling pressure to achieve a particular oscillation rate of the percussive device 100 or allow for higher flow rates to enhance lubrication, cooling, or drill cuttings removal without altering the oscillation rate of the percussive device 100.

Figure 5:
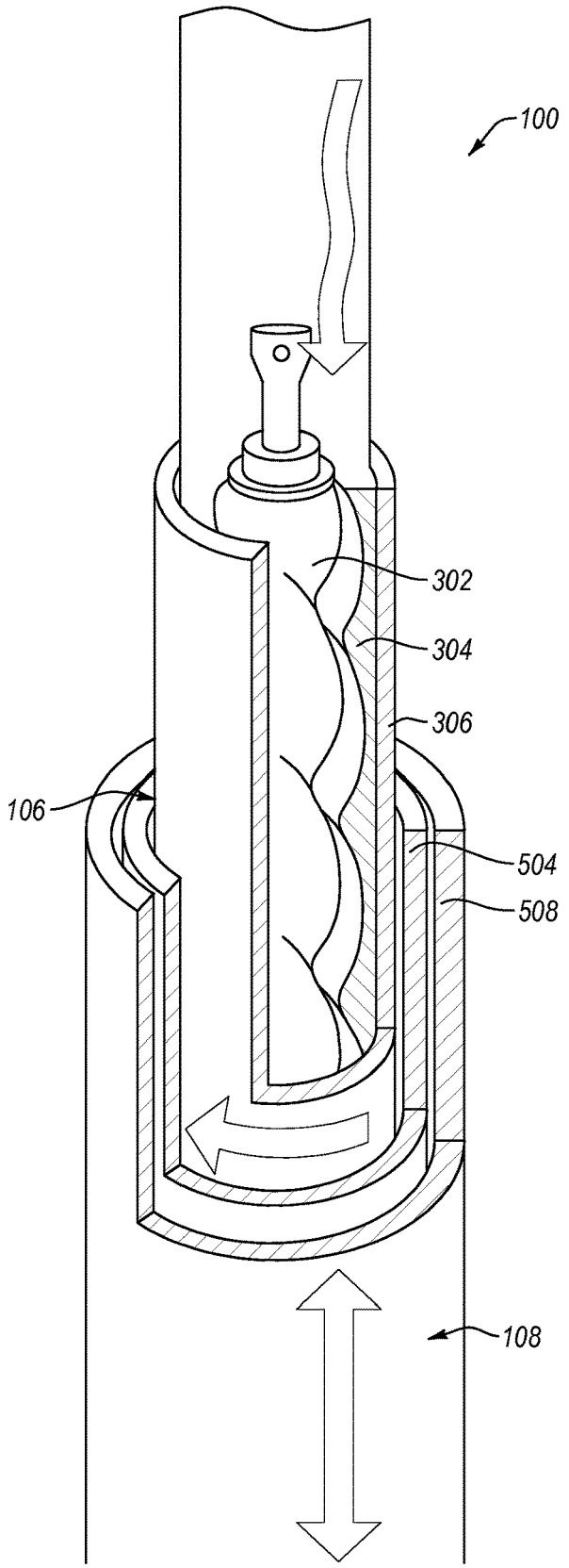
FIG. 5 is a cutaway view of a percussive device, in accordance with an embodiment of the present disclosure.

FIG. 5 depicts a cutaway view of an embodiment of a percussive device 100 including the rotational translator 106 and the axial translator 108. The rotational translator 106 may include the rotational stator 302 and the rotational rotor 304. In the depicted embodiment, the rotational translator 106 may optionally include a PDM as depicted in FIG. 4, and may include a rotational stator 302, a rotational rotor 304, and a rotor body 306. In another embodiment, the rotational translator 106 may include a turbine. In yet another embodiment, the rotational translator 106 may include an electric motor.

As shown in the depicted embodiment, the axial translator 108 may include an axial rotor 504 and an axial stator 508. The axial rotor 504 and the axial stator 508 may collectively and individually be examples of a means for converting rotational motion to oscillating axial motion. In particular, in some embodiments, the axial translator 108 may be at least partially rotationally fixed relative to a BHA or other downhole tools (e.g., downhole tools 102 of FIG. 3), but may be able to move axially relative to the BHA or other downhole tools. The rotation of the rotational translator 106 may be substantially continuous rotation, such as provided by a PDM or a turbine, or may be periodic oscillating rotation as may be provided by an electric motor. The axial translator 108 may, through the axial rotor 504 and the axial stator 508, convert the substantially continuous or periodic oscillating rotational motion of the rotational translator 106 into periodic oscillating axial movement.

In an embodiment, the axial rotor 504 may be coupled to the rotor body 306 or the rotational rotor 304 of the rotational translator 106 such that the rotation of the axial rotor 504 may be associated with the rotation of the rotor body 306 or rotational rotor 304. The rotor body 306 and the rotational rotor 304 may therefore also individually and collectively be examples of means for converting rotational motion into oscillating axial motion. In particular, rotation of the rotor body 306 and/or the rotational rotor 304 may therefore also cause the axial rotor 504 to rotate (e.g., about a central, rotational axis). In one embodiment, the axial rotor 504 may be a separate component coupled to the rotor body 306 and/or the rotational rotor 304. In another embodiment, the axial rotor 504 may be at least partially integrally formed with the rotor body 306 of the rotational translator 106 as a single, monolithic component. In yet another embodiment, the rotor body 306 of the rotational translator 106 and the axial rotor 504 may be wholly integrated into a single, monolithic component.

Figure 6:
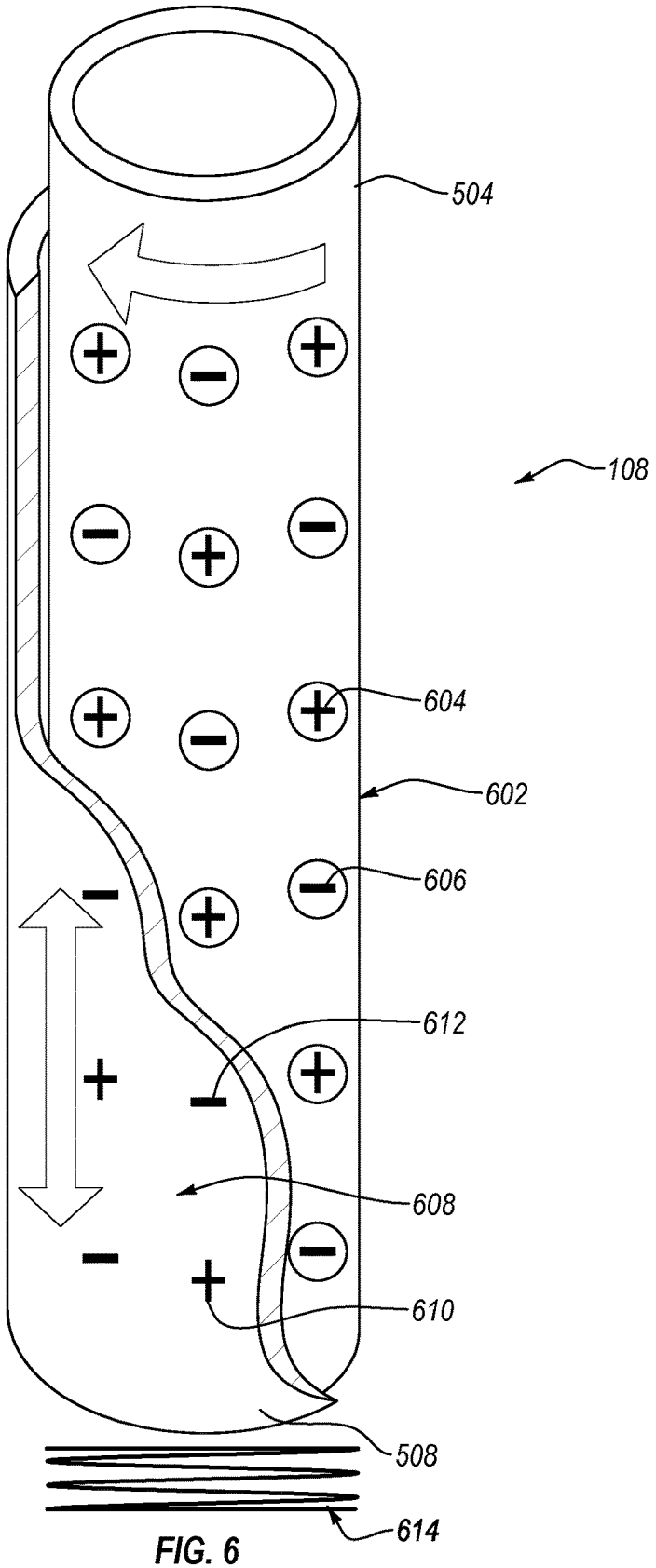
FIG. 6 depicts a magnetic axial translator, in accordance with an embodiment of the present disclosure.

The conversion of the rotational motion of the rotational translator 106 to the axial motion of the axial translator 108 may be achieved in a variety of ways. For instance, FIG. 6 depicts an embodiment of an axial translator 108 including a plurality of magnets having alternating polarities. As shown, the axial rotor 504 may include magnets having positive and negative (or North and South) polarities 604, 606. The magnets may form a rotor array 602 of magnets, and may be located in or adjacent to an outer surface of the axial rotor 504, such that the rotor array 602 includes alternating polarities in the rotational and axial directions. Similarly, the axial stator 508 may include magnets having positive and negative polarities 610, 612. The magnets may form a stator array 608, and may be located in or adjacent to an inner surface of the axial stator 508, such that the stator array 608 includes alternating polarities in the rotational and axial directions. The rotor array 602 and stator array 608 are collectively and individually examples of means for converting rotational motion to oscillating axial motion.

In some embodiments, the axial translator 108 shown in FIG. 6 may be similar to, or include elements of, a radial vibrational device known to those having ordinary skill in the art. In some embodiments, the axial translator 108 may be configured to produce axial movement from rotational movement produced by a rotational translator that is concentric with the axial translator. In other embodiments, an axial translator could include a rotational translator located non-concentrically with an axial translator, and may have an increased length.

In another embodiment, the rotor array 602 and/or the stator array 608 may include a single ring of magnets having alternating polarities. In another embodiment, the rotor array 602 may include a single ring of magnets and the stator array 608 may include more than one ring of magnets. In yet another embodiment, the stator array 608 may include a single ring of magnets and the rotor array 602 may include more than one ring of magnets. In operation, the stator array 608 and rotor array 602, and relative movement between the axial rotor 504 and the axial stator 508 may be used to convert rotation of the axial rotor 504 into an oscillating axial force. Such a force may be used, for example, to move a percussive device (e.g., a percussion hammer bit, a vibration tool, etc.).

More particularly, the axial stator 508 (and potentially the stator array 608) may be fixed (e.g., rotationally fixed) relative to a drill string and/or BHA. The axial rotor 504 may rotate relative to the axial stator 508 and, as a result, magnets of the stator array 608 and rotor array 602 may move past each other and into and out of alignment of magnets having an opposing polarity. Consequently, the rotor array 602 and the stator array 608 may rotate concentrically relative to one another as the axial rotor 504 and the axial stator 508 rotate concentrically relative to one another. In some embodiments, the rotation of the axial rotor 504 may be controlled. For instance, the axial rotor 504 may be rotated a predetermined amount relative to the axial stator 508.

As the axial rotor 504 is rotated, magnetic attraction and repulsion forces between the rotor array 602 and stator array 608 may move the rotor array 608 in the axial/longitudinal direction. In particular, the rotor array 602 and the stator array 608, when concentrically arranged and with the polarity of the rotor array 602 and the stator arrays 608 attracting one another, may use a magnetic attraction force to pull the axial stator 508 into alignment with the axial rotor 504 (i.e., pull the axial stator 508 in an axial/longitudinal direction that aligns magnets of opposing polarities). Due to the alternating pattern of the magnets of the rotor array 602 and the stator array 608, when the axial rotor 504 is rotated relative to the axial stator 508, the rotor array 602 and stator array 608 may have a polarity that repels one another. A magnetic repulsion force may therefore be generated to push the axial stator 508 out of alignment with the axial rotor 504. This repulsion force may push the axial stator 508 in an axial direction (e.g., upward or downward) which moves magnets of the same polarity away from each other, and toward magnets of opposing polarity so that an attraction force can further move the axial rotor 504 in an axial direction. As the axial rotor 504 continues to rotate (e.g., in a predetermined amount) in association with the rotor body 306 (FIG. 5) of the rotational translator 106 (FIG. 5), the axial stator 508 may experience a periodic axial, oscillating force as the magnetic field of the stator array 608 oscillates (when considered from the reference frame of the rotor array 602).

A predetermined or other amount of rotation of the axial rotor 504 may be based at least partially on rotational symmetry of the rotor array 602. In an embodiment, the rotor array 602 may have 180° symmetry with magnets oriented to have the same polarity 180° apart, and alternating polarities at the angular intervals therebetween. For example, the rotor array 602 may have four (4) magnets of alternating polarities at 90° intervals around the axial rotor 504. In another embodiment, the rotor array 602 may have 120° symmetry. For example, the rotor array 602 may include six (6) magnets of alternating polarities at 60° intervals around the axial rotor 504. In yet another embodiment, the rotor array 602 may have 90° symmetry. In a further embodiment, the rotor array 602 may have any other rotational symmetry, and may optionally include at least one (1) magnet with one polarity 604, 606 between two (2) magnets of the opposite polarity 604, 606 to define each sector of symmetry. The stator array 608 may have rotational symmetry substantially matching that of the rotor array 602.

In some embodiments of the present disclosure, the axial stator 508 may include or be coupled to one or more restoring devices 614. A restoring device 614 may apply a force to the axial stator 508 in addition to the axial forces generated between the rotor array 602 and the stator array 608. The additional force from the restoring device 614 may bias the net force on the axial stator 508 in one direction, such as by a force applied to the lower portion of the axial stator 508. In a further embodiment, the restoring device 614 may include one or more mechanical or hydraulic springs, a piston and cylinder, magnets with a polarity oriented in an axial direction to generate a repelling force with the axial stator 508, other devices, or some combination of the foregoing. In FIG. 6, the restoring device 614 is shown as being in a compressed state, but the restoring device 614 may also be in an expanded or other state, and may alternate or otherwise change between states.

The restoring device 614 may, in an embodiment, provide a balancing force to balance the force of gravity acting on the mass of the axial stator 508. In such an embodiment, the magnetic forces between the rotor array 602 and the stator array 608 may accelerate the axial stator 508 substantially similarly in each of two opposing axial directions (e.g., upward/uphole and downward/downhole). As a result, the axial stator 508 may generally move axially between two axial positions. In such an embodiment, the restoring device 614 may bias the axial stator 508 so that an oscillating axial motion is produced, rather than a continuous motion in a single direction. In another embodiment, the restoring device 614 may provide a balancing force to balance more than about 50% of the force of gravity acting on the mass of the axial stator 508. In yet another embodiment, the restoring device 614 may provide a balancing force to balance less than about 50% of the force of gravity acting on the mass of the axial stator 508. In a further embodiment, the restoring device 614 may apply the balancing force in opposition to the force of gravity acting on the rotor array 602 and the stator array 608 by applying an upward force on the axial stator 508. In some embodiments, the axial rotor 504 and the axial stator 508 may have a fluid (e.g., a low-viscosity fluid) in an annular region therebetween to lubricate and cool the axial rotor 504 and the axial stator 508 during operation. In another embodiment, a retention device (e.g., a stop block, collar, or other mechanism) may be provided to restrict or prevent continuous axial motion, or axial movement of the axial stator 508 beyond a particular upper or lower position. As a result, when the axial stator 508 reaches the retention device, continued rotation of the axial rotor 504 may cause magnetic forces between the rotor array 602 and the stator array 608 to move the axial stator 508 away from the retention device. In some embodiments, retention devices may be positioned both above and below the axial stator 508 to facilitate conversion of rotational motion of the axial rotor 504 into oscillating axial motion of the axial stator 508. In some embodiments, the retention device may include or be supplemented with the restoring device 614.

In another embodiment, the restoring device 614 may apply a force in opposition to magnetic forces applies by the interactions of the rotor array 602 and the stator array 608 to dampen or reduce impacts. For example, the restoring device 614 may apply an upward restoring, biasing, or dampening force to decrease acceleration of the axial stator 508 in the downward direction (e.g., toward the bit). The upward force may lessen or prevent an impact between the axial stator 508 and lower components in the drill string or BHA (e.g., between the axial stator 508 and a retention device). Similarly, a restoring device 614 may apply a downward restoring, biasing, or dampening force to decrease acceleration of the axial stator 508 in the upward direction (e.g., away from the bit). The downward force may lessen or prevent an impact between the axial stator 508 and upper components in the drill string or BHA. In some embodiments, the one or more restoring devices 614 may be positioned below the axial stator 508, above the axial stator 508, or both above and below the axial stator 508. The restoring devices 614 may therefore apply an upward balancing force on the axial stator 508, a downward balancing force on the axial stator 508, or both. In at least some embodiments, a single restoring device 614 may apply both an upward and downward balancing force on the axial stator 508. By way of example, the restoring device 614 may comprise a spring or other biasing element connected to one end of the axial stator 508 ad shown in FIG. 6. The restoring device 614 may apply an upward balancing force to the axial stator 508 as the axial stator 508 moves downward, compressing the restoring device 614. Similarly, the restoring device 614 may apply a downward balancing force to the axial stator 508 as the axial stator moves upward, extending the restoring device 614.

The axial rotor 504 and the axial stator 508 may also include non-magnetic components. In an embodiment, the axial rotor 504 and axial stator 508 may each include a non-magnetic body that houses or otherwise holds the individual magnets of the rotor array 602 and the stator array 608, respectively. In another embodiment, the axial rotor 504 and the axial stator 508 may each include a body made of titanium, aluminum, magnesium, non-magnetic alloys or materials, or a combination thereof, and which houses the individual magnets of the rotor array 602 and stator array 608.

As discussed herein, and returning briefly to FIG. 5, the axial rotor 504 may be connected to the rotor body 306 or rotational rotor 304 of the rotational translator 106, and rotation of the axial rotor 504 may be associated with rotation of the rotor body 306 and/or rotational rotor 304. In another embodiment, the axial rotor 504 may be at least partially integrally formed with the rotor body 306 of the rotational translator 106. In yet another embodiment, the rotor body 306 of the rotational translator 106 may combine the rotor body 306 of the rotational translator 106 and the axial rotor 504 into a single, integral component. The rotor body 306 may, in such an embodiment, have a rotor array in or adjacent to an outer surface thereof. In another embodiment, the rotor body 306 may have a rotor array in or adjacent to the outer surface thereof and a molded elastomer rotor 304 on the inner surface thereof.

Figures 1, 7:
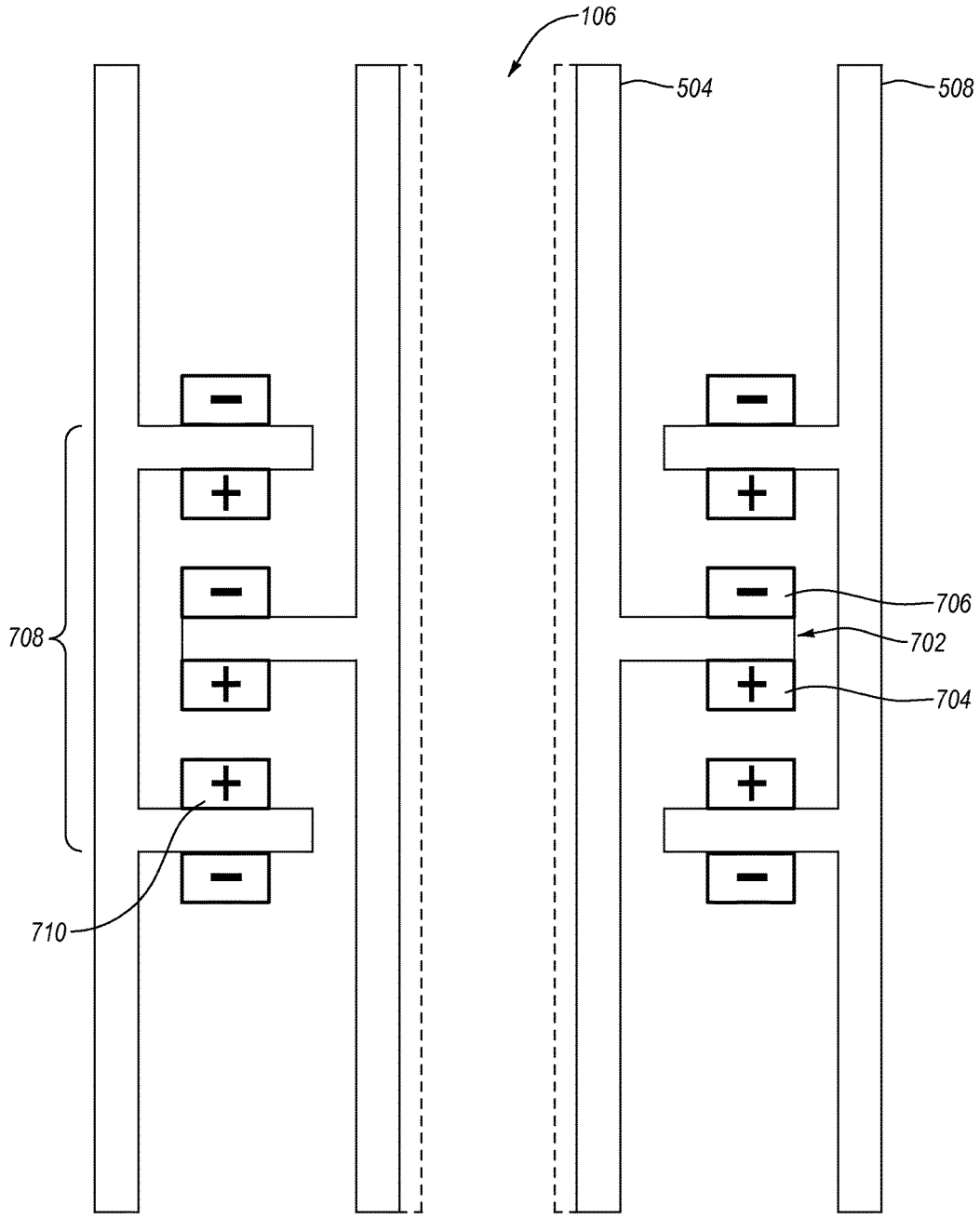
Figures 2, 7:
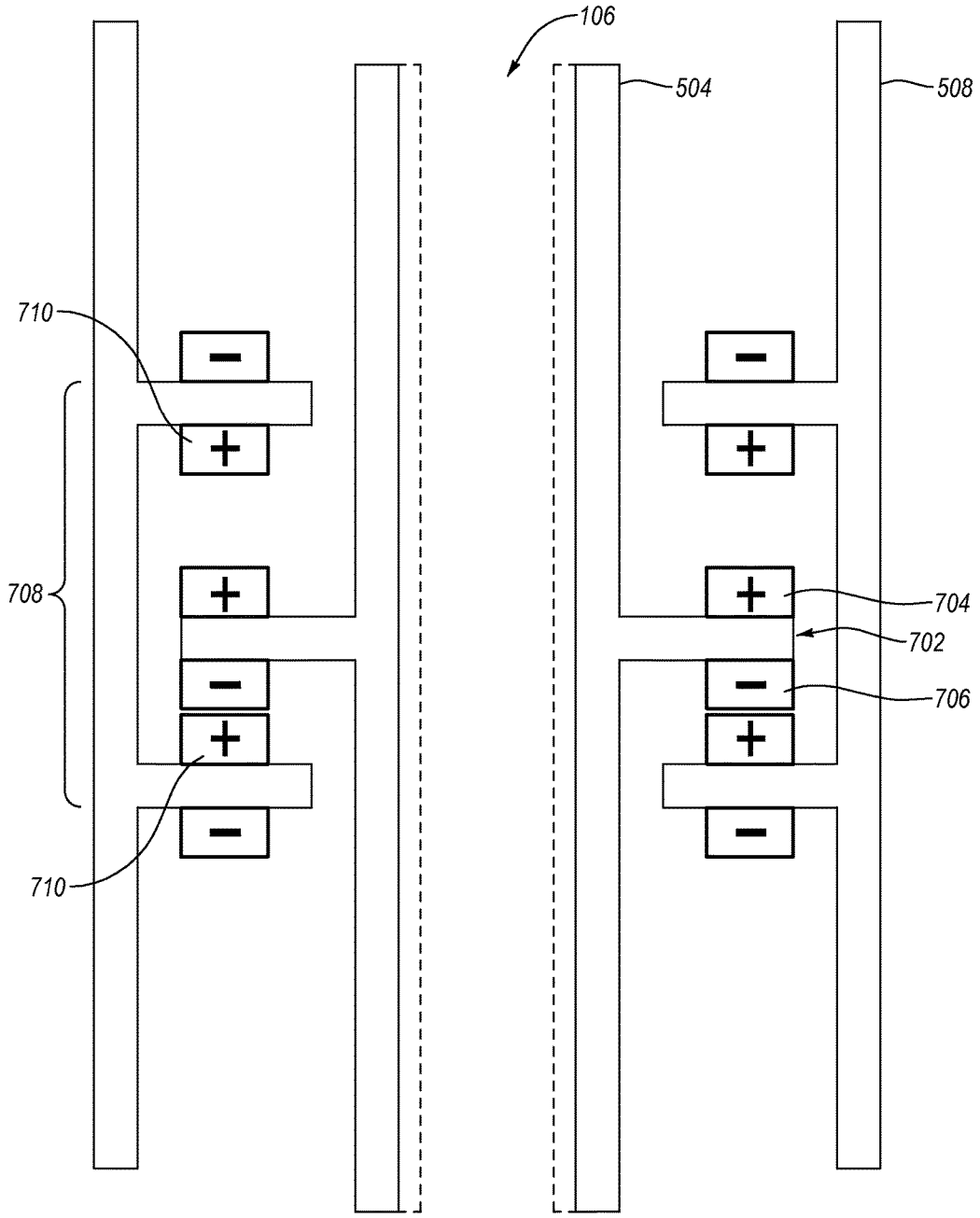

FIGS. 7-1 and 7-2 depict another manner for converting rotational motion to axial motion. More specifically, FIGS. 7-1 and 7-2 depict an embodiment of an axial translator 108 that includes various magnets arranged in a stator array 708 and a rotor array 702. In this particular embodiment, the axial translator 108 includes an axial rotor 504 which may include a generally tubular body 712 having one or more radial fins 714 (one is shown) extending outwardly therefrom. The rotor array 702 may be coupled to the radial fin 714 in some embodiments. The axial stator 508 may include a tubular body 716 concentric with the tubular body 712 of the axial rotor 504, with one or more radial fins 718 (two are shown) extending inwardly therefrom. In this embodiment, the two radial fins 718 of the axial stator 508 are positioned on opposite axial sides of the radial fin 714 of the axial rotor 504, and the stator array 708 including magnets on each of the radial fins 718. According to some embodiments, the radial fins 714, 718 may be formed as continuous rings extending around the respective tubular bodies 712, 716. In other embodiments, the radial fins 714, 718 may be interrupted or non-continuous, or may have other structures. In still other embodiments, the radial fins 714, 718 may be omitted. For instance, the rotor array 702 may be coupled directly to the outer surface of the axial rotor 504 (e.g., the magnets may extend radially outward) and/or the stator array 708 may be coupled directly to the interior surface of the axial stator 508 (e.g., the magnets may extend radially inward).

The rotor array 702 may include a plurality of magnets positioned to orient the positive and negative polarities 704, 706 in opposite axial directions on the radial fins 714. In particular, FIG. 7-1 illustrates a first position of the axial rotor 504, and shows the positive polarity 704 oriented downward while the negative polarity 706 is oriented upward. The rotor array 702 may also include additional magnets extending circumferentially around the radial fins 714. In at least some embodiments, circumferentially or angularly adjacent magnets may be oriented in the opposite directions of polarity to produce an alternating pattern around the radial fins 714.

The axial rotor 504 may be rotated relative to the axial stator 508, and due to the alternating positive and negative polarities 704, 706 extending around the exterior of the axial rotor 504, magnets of alternating polarity may pass or through the stator array 708. Due to this alternating pattern, the stator array 708 and the rotor array 702 may be used to convert rotation of the axial rotor 504 into axial translation of the axial stator 508. In the embodiment of FIG. 7-1, for instance, the magnets of the stator array 708 are shown as being positioned on each radial fin 718 and oriented to have a positive polarity 710 directed axially toward the rotor array 702 on the radial fin 714. The stator array 708 and the rotor array 702 may also be radially aligned by positioning the magnets about the same radial distance from the tubular body 512. As a result, when the axial rotor 504 is in the first position shown in FIG. 7-1, the negative polarity 706 of the axial rotor 504 may be attracted to a magnet having positive polarity 710 within the stator array 708, and the positive polarity 704 of the axial rotor 504 may be repelled by the positive polarity 710 of the stator array 708. As the negative polarity 706 is below the positive polarity 710 to which it is attracted in FIG. 7-1, and the positive polarity 704 is above the positive polarity 710 from which it is repelled, the combined magnetic attraction and repulsion forces may therefore cause the axial stator 508 to move in a downward axial direction. The stator array 708, rotor array 702, and radial fins 714, 718 may therefore, collectively and individually, be considered examples of means for converting rotational motion to oscillating axial motion.

FIG. 7-2 depicts a second position of the rotor array 702, and particularly shows an example embodiment in which the rotor array 702 has been rotated relative to the axial stator 508, such that magnets of the rotor array 702 now have the opposite polarity of that shown in FIG. 7-1. In particular, the rotor array 702 is shown with magnets having the positive polarity 704 oriented upward, and the negative polarity 706 oriented downward. FIG. 7-2 shows the same reference frame for the axial stator 708, and the magnets of the stator array 708 may therefore continue to have the positive polarity 710 oriented toward the radial fin 714 and axial rotor 702. Due to the change in orientation of the polarities 704, 706, the second position shown in FIG. 7-2 may result in the axial stator 508 being moved in an upward direction. In particular, the negative polarity 706 of the axial rotor 504 may again be attracted to a magnet having positive polarity 710 within the stator array 708, and the positive polarity 704 of the axial rotor 504 may again be repelled by the positive polarity 710 of the stator array 708. As the negative polarity 706 is now above the positive polarity 710 to which it is attracted in FIG. 7-2, and the positive polarity 704 is below the positive polarity 710 from which it is repelled, the combined magnetic attraction and repulsion forces may therefore cause the axial stator 508 to move in an upward axial direction. In some embodiments, the axial translator 108 shown in FIGS. 7-1 and 7-2 may be similar to, or include elements of, a magnetic hammer device known to those having ordinary skill in the art. In some embodiments, the axial translator 108 may be configured to produce axial movement from rotational movement produced by a rotational translator that is concentric with the axial translator. In other embodiments, the axial translator may be positioned non-concentrically relative to the rotational translator, and the length of the corresponding percussive device may be increased.

As discussed herein, the rotor array 702 and the stator array 708 of FIGS. 7-1 and 7-2 may each include multiple, circumferentially positioned magnets. The predetermined or other amount of rotation of the axial rotor 504 relative to the axial stator 508 may be at least partially based upon the angular or circumferential spacing between the magnets, the rotational symmetry of the rotor array 702, the rotational symmetry of the stator array 708, or some combination of the foregoing. In an embodiment, the rotor array 702 may have 180° symmetry with identical polarities on opposing sides of the stator array 708 (i.e., 180° apart), and alternating polarities angularly spaced therebetween. For example, the rotor array 702 may have magnets at four (4) angular positions each 90° apart, and with alternating polarities therebetween, such that adjacent magnets have opposite polarities. In such an embodiment, FIG. 7-2 may depict a 90° or 270° rotation of the axial rotor 504 and the rotor array 702 as compared to the embodiment shown in FIG. 7-1, which may produce axial movement of the axial stator 508 in the opposite axial direction as compared to the embodiment of FIG. 7-1. In another embodiment, the rotor array 702 may have 120° symmetry. For example, the rotor array 702 may include magnets at six (6) or angular positions each 60° apart and with alternating polarities, such that adjacent magnets have opposite polarities. In such an embodiment, every 60° of rotation may align magnets of opposite polarities and produce opposite axial movement of the axial stator 508. In yet another embodiment, the rotor array 702 may have 90° symmetry with magnets at eight (8) angular positions that are 45° apart. In a further embodiment, the rotor array 702 may have any other number of magnets or angular positions of magnets, and may have rotational symmetry with one, two, or more magnets with opposite polarities located in each sector of symmetry. For instance, the rotor array 702 may have 360° symmetry with magnets at two (2) angular positions, 72° symmetry with magnets at ten (10) angular positions, 60° symmetry with magnets at twelve (12) angular positions, 45° symmetry with magnets at sixteen (16) angular positions, or the like. In other embodiments the rotor array 702 may include magnets at more than sixteen (16) angular positions around the axial rotor 702. The number of magnets may also correspond to the number of angular positions, there may also be multiple axial rows of magnets, which rows may be angularly aligned or offset relative to each other. The stator array 708 may have magnets and rotational symmetry substantially matching that of the rotor array 702. In some embodiments, the stator array 708 may include more magnets than the rotor array 702. In FIGS. 7-1 and 7-2, for instance, there are two rows of magnets in the stator array 708 and a single row of magnets in the rotor array 702. In other embodiments, there may be more magnets on the rotor array 702 than on the stator array 708 (e.g., where there are two rows of magnets in the rotor array 702 and one row of magnets in the stator array 708).

Figure 8:
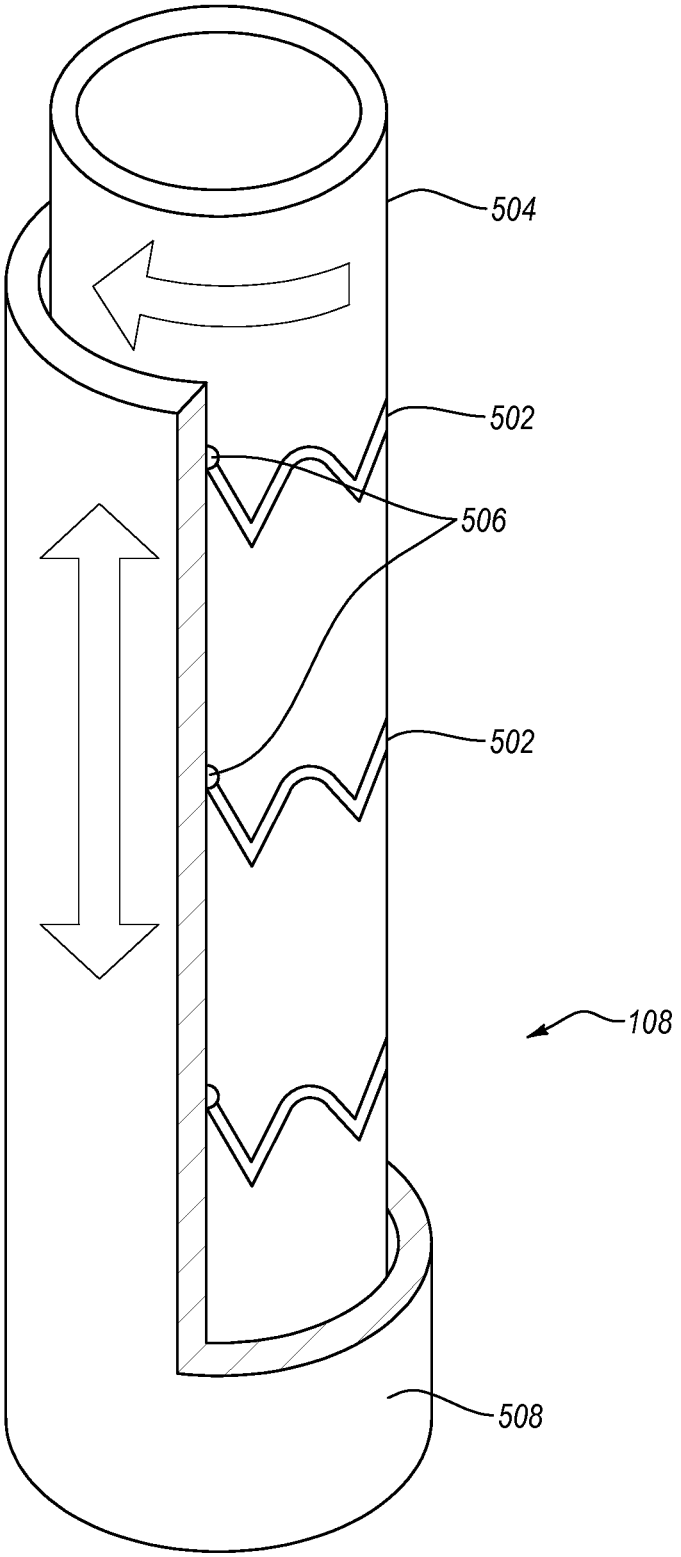
FIG. 8 is a perspective view of a mechanical axial translator, in accordance with an embodiment of the present disclosure.

FIG. 8 illustrates yet another manner for converting rotational motion to axial motion. As shown in FIG. 8, the axial translator 108 may include an axial rotor 504 and an axial stator 508 similar to the embodiment of FIG. 6; however, instead of magnetically converting rotational movement to axial movement (e.g., periodic oscillating axial movement), the embodiment of FIG. 8 may mechanically convert the rotational movement to periodic oscillating axial movement.

The axial translator 108 may mechanically translate the substantially continuous rotational movement or periodic oscillating movement of the rotational translator 106 into periodic oscillating axial movement. In the depicted embodiment, the axial translator 108 may include one or more recesses 502 in an outer surface of an axial rotor 504. The recesses 502 may extend circumferentially around the axial rotor 504. Optionally, the recesses 502 have an undulating or other shape. In FIG. 8, for instance, the recesses 502 may have a generally sinusoidal or wave-like form.

The axial translator 108 may include protrusions 506 (e.g., rollers, pins, cam followers, etc.) extending from the inner surface of an axial stator 508. The protrusions 506 may align with the recesses 502, and may even extend into the recesses 502. As a result, as the axial rotor 504 rotates relative to the axial stator 508, the protrusions 506 may move within or along the recesses 502. Where the recesses 502 have an undulating or other shape that moves axially and circumferentially along the axial rotor 504, the protrusions 506 may move axially relative to the axial rotor 504, thereby also moving the axial stator 508 axially upward and downward relative to the axial rotor 504. The axial position of the axial stator 508 relative to the axial rotor 504 may thus correspond to the position of the protrusions 506 within the recesses 502. The protrusions 506 and the recesses 502 may therefore also collectively and individually be examples of means for converting rotational motion into oscillating axial motion.

In an embodiment, the axial rotor 504 may be separate from the rotational rotor 304 or the rotor body 306 depicted in FIG. 4, but coupled thereto. In another embodiment, the axial rotor 504 may be integral with the rotational rotor 304 and/or the rotor body 306. The rotational rotor 304 and the rotor body 306 may also be integrally formed or may even be the same component. In yet another embodiment, the axial rotor 504 and the rotational rotor 304 may be of differing lengths and at least part of the axial rotor 504 may be integral with at least part of the rotational rotor 304. In some embodiments, axial rotor 504 and axial stator 508 may have a fluid (e.g., a low-viscosity fluid) in the annular region therebetween to lubricate and cool the axial rotor 504 and axial stator 508 during operation.

Figure 9:
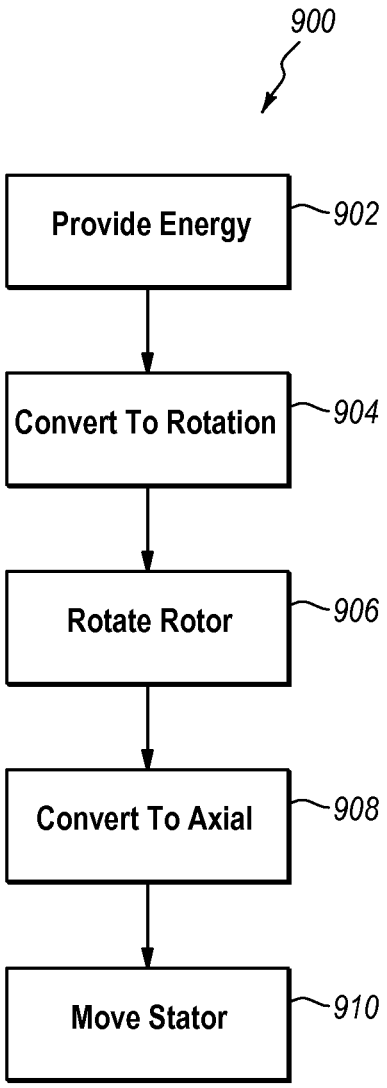
FIG. 9 is a flowchart illustrating a method of providing power to a rotary percussion device, in accordance with an embodiment of the present disclosure.

A method of providing a repeated percussive force is also described herein. At least some of the embodiments of a rotary percussive device described herein may be used to accomplish this method. As shown in FIG. 9, a method 900 may include providing energy (902) and converting the energy provided by the source to rotational energy (904). In some embodiments, the energy that is provided may be hydraulic, electric, or other energy. For instance, drilling mud may be provided through a drill string. The provided drilling mud may flow generally axially within the drill string, and energy from the flowing drilling mud may be translated to rotation (904). Optionally, a rotational translator may be used to convert the energy from axial energy to rotational energy. Examples of rotational translators may include rotational translator 106 of FIGS. 2 through 5, progressive cavity motors, rotary-type positive displacement motors, PDMs, other types of convertors or motors, or any combination of the foregoing. In some embodiments, the rotational energy may be periodic, whereas in other embodiments the rotational energy may be continuous. In an embodiment, the rotational translator may be axially and/or rotationally fixed to a BHA or other downhole tool.

When the energy has been converted to rotational energy (904), the rotational energy may be used to rotate a rotor (906). The rotor may rotate by direct application of force from the energy source, through hydraulic communication, through a mechanical linkage, or in any other suitable manner. The rotational movement of the rotating rotor may be converted (908) to axial movement (e.g., by an axial translator), which may cause the stator to move in an axial direction (910).

As discussed herein, in an embodiment, providing the energy (902) may include providing fluid pressure and/or a fluid flow. The fluid pressure may be a drilling fluid pressure provided by a drilling fluid or drilling mud. The fluid pressure and/or fluid flow may converted by a rotational translator to a rotational force acting about a rotational axis (904). In another embodiment, a PDM may produce the rotational force from the fluid pressure. In yet another embodiment, a turbine may produce the rotational force from the fluid pressure. In at least some embodiments, a PDM may produce higher torque than a turbine when each uses an equivalent fluid pressure to rotate a rotor. According to some embodiments, a turbine may produce higher angular velocity than a PDM when each uses an equivalent fluid pressure to rotate a rotor.

In another embodiment, rotating the rotor (906) may include rotating a rotational rotor of the rotational translator. The rotational rotor may be rotated by the energy source used to produce relative rotation between the rotational rotor and a rotational stator. In yet another embodiment, rotating the rotor (906) may include rotating an axial rotor of an axial translator. A rotational rotor of a rotational translator may be at least partially integrally formed with the axial rotor of the axial translator, in some embodiments. In such an embodiment, the rotational force of the rotational translator may be directly or indirectly applied to the axial rotor of the axial translator, which may then translate the motion to axial motion (908) to produce the axial movement of the axial stator (910).

In a further embodiment, converting the rotational motion (908) of the axial rotor to an axial motion of the axial stator may include the use of magnetic forces. The movement of the axial stator may be produced by, for instance, the interaction of a magnetic array in or on an axial rotor with a magnetic array in or on an axial stator. The magnetic arrays may include magnets arranged to have alternating polarities, such that as the axial rotor rotates, magnetic attraction and repulsion forces may move the axial stator in an axial direction. In such an embodiment, the axial rotor may be concentric with the axial stator, and optionally has a diameter less than a diameter of the axial stator. In another embodiment, the axial rotor may have a diameter greater than a diameter of the axial stator. In yet another embodiment the rotational rotor may have a diameter less than the diameter of the axial stator.

While percussive devices have been described herein primarily with reference to a downhole drilling system that allows for percussive impacts to break or otherwise remove material in a wellbore (e.g., using a percussion hammer drill bit), percussive devices of the present disclosure may be used for other purposes or in other fields or industries. For instance, a percussive device of the present disclosure may be used to generate an axial percussive force that is not used to deliver a percussive force to a bit, or which is not used in a well or wellbore. In an embodiment, a percussive device according to one or more embodiments of the present disclosure may be included on, or coupled to, a BHA or other component on a drill string. The percussive device may, for instance, deliver an axial impulse to the drill string or BHA to vibrate or shake the drill string or BHA. The axial impulse may be sufficient to free a stuck drill string, BHA, or tool, or to clear debris from the annular space around the drill string or BHA in the wellbore. The percussive device may instead, or additionally, produce oscillating vibrations that may be used to facilitate conveyance of drill string and/or casing within a wellbore. In other embodiments, percussive devices according to the present disclosure may be used outside a well or other downhole environment. For instance, a percussive device of the present disclosure may be used in a borehole used for placement of utility lines. Accordingly, the term "wellbore" should not be interpreted as limiting tools, systems, assemblies, or methods of the present disclosure to any particular industry or field.

As will be appreciated by a person having skill in the art in view of the present disclosure, various embodiments are disclosed herein which relate to devices, systems, and methods for generating a percussive force. Some example embodiments may be used within a downhole environment to, for example, move a drill bit in a percussive manner to break away materials of the surrounding formation and drill or otherwise extend a wellbore. In some embodiments, portions of the drilling system may be rigid. A drill string or BHA may, for instance, be substantially rigid to minimize bending and/or twisting during a downhole drilling or other operation. The rigidity of the downhole components may be a matter of design in response to operational concerns (e.g., that a rotating shaft would suffer performance degradation if formed of a softer or more pliable material, that weight-on-bit would be reduced if components could more easily bend, etc.). Different rigid components may be coupled to each other through rigid or flexible joints or connectors.

Although rigidity may allow for various components to perform their desired function, the rigidity may also limit maneuverability or other performance of the downhole components. For instance, if a wellbore curves or a deviated borehole is formed off a primary wellbore, the rigidity of the BHA may limit the amount or rate of bend that may be used in connection with the BHA. This is particularly true for larger rigid sections. For instance, as torque is to be increased, a downhole mud motor may become larger and the length and/or diameter of the mud motor may increase. As the mud motor becomes larger, the mud motor (and corresponding BHA) may be more rigid and longer, and may reduce the ability to maneuver the mud motor along different contours or bends of a wellbore. A BHA having a long, continuously rigid section may therefore be more likely to become stuck in a wellbore, and may decrease an operator's ability to direct the BHA precisely or to turn a wellbore or borehole horizontally. Increased lengths of rigid portions of the BHA may also increase the strain on couplings or joints within the BHA. Additionally, as the rigid portions of a drill string or BHA become longer, the torque placed on couplings between components increases and the risk of a coupling failing grows.

Some embodiments herein may therefore be configured to reduce lengths of rigid sections within a BHA. As discussed herein, for instance, a percussive device may include components for converting fluid pressure to rotational energy, and then converting the rotational energy to percussive, axial energy. In at least some embodiments, a rotational translator for converting fluid pressure to rotational energy may be concentric with an axial translator for converting the rotational energy to percussive, axial energy. As compared with a percussive device of the present disclosure that includes a rotational translator that is axially offset from, and perhaps rigidly coupled to, the axial translator, providing at least some longitudinal overlap between the rotational translator and the axial translator, may reduce the length of the percussive device and allow increased maneuverability, reliability, and adaptability.

When introducing elements of various embodiments of the present disclosure, the articles "a," "an," and "the" are intended to mean that there are one or more of the elements. Additionally, it should be understood that references to "one embodiment" or "an embodiment" of the present disclosure are not intended to be interpreted as excluding the existence of additional embodiments that also incorporate the recited features. Elements of particular embodiments should not be understood as exclusive from one another. Rather, any elements described in the context of a particular embodiment may be applied to other embodiments, as appropriate.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount.

It should be understood terms describing the position or movement of certain components or features are relative only, and that that any positions, directions, or movements in the description are merely relative, and may relate to a single reference frame. For example, the terms "up," "down," "upward," "downward," "above," "below," and the like merely describe an example relative position or movement of the elements of some embodiments of the present disclosure, but other relational terms may be used where a device, system, or assembly of the present disclosure is manipulated in space, or where a different reference frame is used such that the position, direction, or movement may appear to be different. Additionally, the terms "rotor" and "stator" are intended to describe certain components which have certain movement relative to one another. From the perspective of one reference frame, for instance, the stator may appear rotationally stationary while the rotor rotates. In another reference frame, the stator may appear to rotate while the rotor remains rotationally stationary. In still another reference frame, or both the rotor and stator may rotate (e.g., at the same rate or at different rates). The terms "couple," "coupled," "connect," "connection," "connected," "in connection with," and "connecting" refer to being in direct connection with, integral with, or connected via one or more intermediate elements or members. Components may be "integral" when collectively formed from a single, monolithic component (which component may be made of one or more materials). Thus, by way of example only, two (2) components collectively during an extrusion, molding, forming, machining, or other process (or set of processes) may be considered to be integral. In contrast, where two (2) components formed separately from the same or different materials and then joined together using mechanical fasteners, adhesives, welding, brazing, or other similar processes, the components may not be considered to be "integral."

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A rotary percussive device, comprising:

a rotational translator having a rotational rotor and a rotational stator;

an axial translator having an axial stator and an axial rotor, the axial translator being concentric with the rotational translator; and a plurality of magnets coupled to the axial translator, wherein the axial rotor and axial stator each include some of the plurality of magnets arranged as angularly and longitudinally offset magnets of alternating polarity.

2. The device of claim 1, wherein the rotational translator comprises a positive displacement motor, an electric motor, or a turbine.

3. The device of claim 1, wherein the rotational translator is concentrically within the axial translator and is shorter than the axial translator.

4. The device of claim 1, wherein the rotational rotor is at least partially integrally formed with the axial rotor.

5. The device of claim 1, wherein the axial translator further comprises a non-magnetic body in which the plurality of magnets are held.

6. The device of claim 5, wherein the non-magnetic body is part of the axial rotor.

7. A bottomhole assembly, comprising:

a percussive device including:

a rotational translator having a rotational rotor and a rotational stator, the rotational translator being configured to convert fluid pressure to torque;

an axial translator having an axial stator and an axial rotor, the axial translator being concentric with the rotational translator, the axial rotor being coupled to, and rotatable by, the rotational translator, the axial stator and the axial rotor cooperating to convert rotational movement of the axial rotor into axial movement of the axial stator; and a percussion hammer drill bit coupled to the axial stator and axially movable therewith; and a downhole tool coupled to the percussive device and providing a fluid passageway to the rotational translator, the rotational stator being rotationally fixed to the downhole tool.

8. The bottomhole assembly of claim 7, wherein the rotational translator comprises a positive displacement motor or a turbine.

9. The bottomhole assembly of claim 8, wherein the rotational stator includes a drive shaft of the rotational translator, the drive shaft being rotationally fixed to the downhole tool, and the rotational rotor and axial rotor being rotatable relative to the drive shaft and the downhole tool.

10. The bottomhole assembly of claim 7, wherein the axial stator comprises a plurality of magnets, the plurality of magnets being oriented with alternating polarities in an array extending in angular and longitudinal directions.

11. The bottomhole assembly of claim 7, wherein the rotational rotor comprises a plurality of magnets, the plurality of magnets being oriented with alternating polarities in an array extending in angular and longitudinal directions.

12. The bottomhole assembly of claim 7, wherein the rotational translator is configured to produce less than 10,000 foot-pounds (13.6 kilonewton-meters) of torque.

13. The device of claim 7, wherein the rotational translator is configured to produce less than 5,000 foot-pounds (6.8 kilonewton-meters) of torque.

14. The device of claim 7, wherein the rotational translator is configured to produce less than 1,500 foot-pounds (2.0 kilonewton-meters) of torque.

15. A method of providing rotary power to a rotary percussive device, the method comprising:

producing a torque using a rotational translator including a rotational stator and rotational rotor;

using the torque to cause the rotational rotor to rotate; and converting rotation of the rotational rotor to axial motion and thereby causing an axial stator to move axially, the axial stator longitudinally overlapping the rotational stator.

16. The method of claim 15, further comprising:

using rotation of the rotational rotor to rotate an axial rotor about a rotational axis.

17. The method of claim 16, wherein causing the axial stator to move axially includes causing the axial stator to move in a direction generally parallel to the rotational axis.

* * * * *